US008740330B2

(12) United States Patent
Ozawa et al.

(10) Patent No.: US 8,740,330 B2
(45) Date of Patent: Jun. 3, 2014

(54) LIQUID EJECTING METHOD, LIQUID EJECTING HEAD, AND LIQUID EJECTING APPARATUS

(75) Inventors: Kinya Ozawa, Shiojiri (JP); Junhua Zhang, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/311,991

(22) Filed: Dec. 6, 2011

(65) Prior Publication Data

US 2012/0081468 A1 Apr. 5, 2012

Related U.S. Application Data

(63) Continuation of application No. 12/410,664, filed on Mar. 25, 2009, now Pat. No. 8,109,588.

(30) Foreign Application Priority Data

Mar. 26, 2008 (JP) ..... 2008-081746
Nov. 28, 2008 (JP) ..... 2008-305331

(51) Int. Cl.
*B41J 29/38* (2006.01)
*B41J 2/15* (2006.01)
*B41J 2/135* (2006.01)
*B41J 2/045* (2006.01)

(52) U.S. Cl.
USPC ..... 347/9; 347/40; 347/44; 347/68

(58) Field of Classification Search
USPC ..... 347/9, 44, 47, 40, 68
See application file for complete search history.

(56) References Cited

U.S. PATENT DOCUMENTS

| | | | | |
|---|---|---|---|---|
| 4,475,113 | A | 10/1984 | Lee et al. | |
| 5,933,168 | A * | 8/1999 | Sakai | 347/70 |
| 6,412,926 | B1 * | 7/2002 | Okuda | 347/70 |
| 7,334,879 | B2 | 2/2008 | Takahashi | |
| 7,871,143 | B2 | 1/2011 | Ahne et al. | |
| 8,109,588 | B2 * | 2/2012 | Ozawa et al. | 347/9 |
| 2004/0080574 | A1 | 4/2004 | Masumi | |
| 2004/0113962 | A1 * | 6/2004 | Mori | 347/12 |
| 2006/0050111 | A1 * | 3/2006 | Mataki | 347/68 |
| 2008/0049056 | A1 * | 2/2008 | Teramae | 347/11 |
| 2008/0143785 | A1 * | 6/2008 | Houjou | 347/45 |

FOREIGN PATENT DOCUMENTS

| | | |
|---|---|---|
| JP | 2005-034998 | 2/2005 |
| JP | 2005-297557 | 10/2005 |
| JP | 2007-144886 | 6/2007 |

OTHER PUBLICATIONS

U.S. Appl. No. 12/410,664, Sep. 6, 2011, Notice of Allowance.

* cited by examiner

*Primary Examiner* — Jason Uhlenhake
(74) *Attorney, Agent, or Firm* — Workman Nydegger

(57) ABSTRACT

Provided is a liquid ejecting method, including: ejecting a liquid from a liquid ejecting head, wherein the viscosity of the liquid is in a range from 6 mPa·s to 20 mPa·s, wherein the liquid ejecting head includes: nozzles which eject the liquid; a pressure chamber which applies a pressure variation to the liquid in order to eject the liquid from the nozzles; and a supply unit which communicates with the pressure chamber and supplies the liquid to the pressure chamber, and wherein the opening area of the nozzles on the side in which the liquid is ejected is 1/10 or less of the opening area of the opening of the supply unit on the pressure chamber side.

10 Claims, 13 Drawing Sheets

LIQUID EJECTING METHOD, LIQUID EJECTING HEAD, AND LIQUID EJECTING APPARATUS

This application is a Continuation of U.S. patent application Ser. No. 12/410,664 filed on Mar. 25, 2009 which claims priority to Japanese Patent Application Nos. 2008-081746, filed Mar. 26, 2008 and 2008-305331, filed Nov. 28, 2008 which are expressly incorporated herein by reference.

BACKGROUND

1. Technical Field

The present invention relates to a liquid ejecting method, a liquid ejecting head, and a liquid ejecting apparatus.

2. Related Art

A liquid ejecting apparatus such as an ink jet printer includes a liquid ejecting head including nozzles for ejecting a liquid, a pressure chamber for providing a pressure variation to the liquid such that the liquid is ejected from the nozzles, and a supply unit for supplying the liquid stored in a reservoir to the pressure chamber. In this liquid ejecting head, the size of a liquid channel in the head is determined on the basis of a liquid having viscosity close to that of water (See JP-A-2005-34998).

Recently, a liquid having viscosity higher than that of a general ink attempts to be ejected using an ink jet technology. In addition, if the liquid having the high viscosity is ejected by a head having the existing shape, the ejection of the liquid becomes unstable. For example, flight deflection of the liquid occurs or shortage of the ejection amount of the liquid occurs.

SUMMARY

An advantage of some aspects of the invention is that the ejection of a liquid having viscosity higher than that of a general ink becomes stable.

According to an aspect of the invention, there is provided a liquid ejecting method, including ejecting a liquid from a liquid ejecting head, wherein the viscosity of the liquid is in a range from 6 mPa·s to 20 mPa·s, wherein the liquid ejecting head includes: nozzles which eject the liquid; a pressure chamber which applies a pressure variation to the liquid in order to eject the liquid from the nozzles; and a supply unit which communicates with the pressure chamber and supplies the liquid to the pressure chamber, and wherein the opening area of the nozzles on the side in which the liquid is ejected is 1/10 or less of the opening area of the opening of the supply unit on the pressure chamber side.

The other features of the invention will become apparent from the description of the present specification and the accompanying drawings.

BRIEF DESCRIPTION OF THE DRAWINGS

The invention will be described with reference to the accompanying drawings, wherein like numbers reference like elements.

FIG. 3 is a block diagram explaining the configuration of a driving signal generation circuit and the like.

DESCRIPTION OF EXEMPLARY EMBODIMENTS

Figure 1:
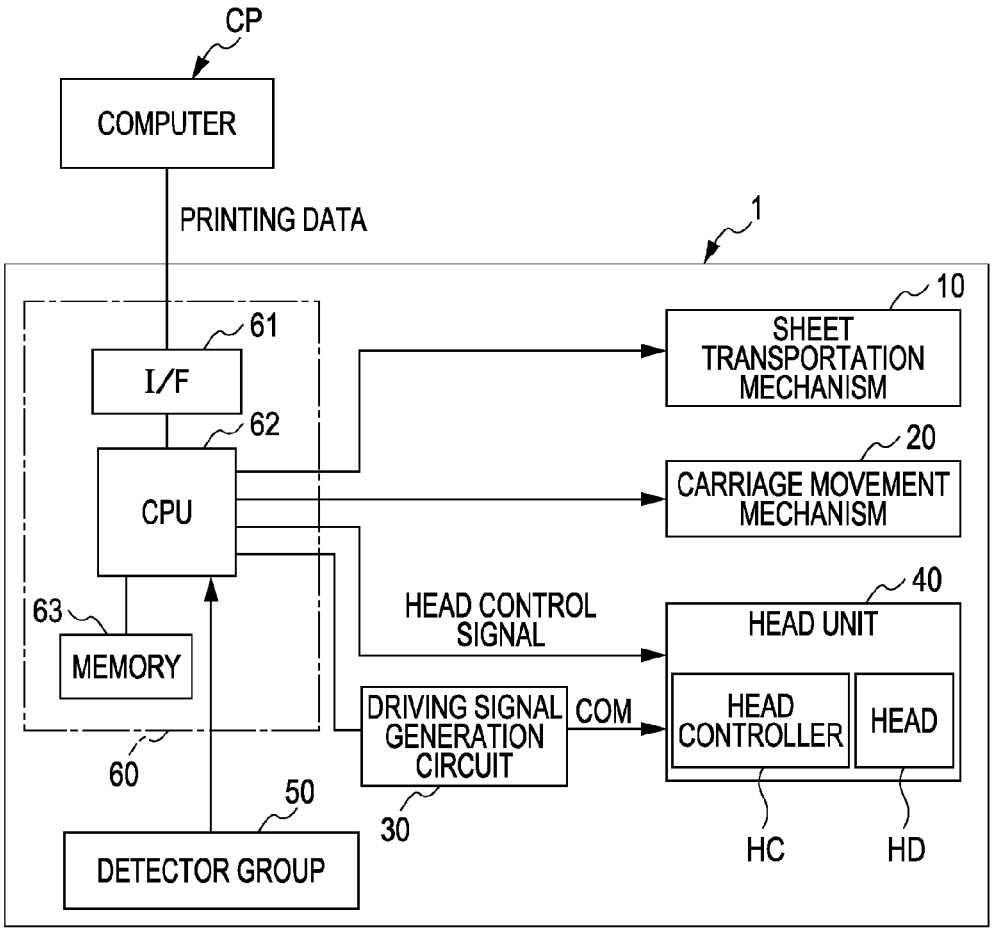
FIG. 1 is a block diagram explaining the configuration of a printing system.

At least the following will become apparent from the specification and the accompanying drawings.

That is, it will become apparent that, as a liquid ejecting method, a liquid ejecting method, including ejecting a liquid from a liquid ejecting head, wherein the viscosity of the liquid is in a range from 6 mPa·s to 20 mPa·s, wherein the liquid ejecting head includes: nozzles which eject the liquid; a pressure chamber which applies a pressure variation to the liquid in order to eject the liquid from the nozzles; and a supply unit which communicates with the pressure chamber and supplies the liquid to the pressure chamber, and wherein the opening area of the nozzles on the side in which the liquid is ejected is 1/10 or less of the opening area of the opening of the supply unit on the pressure chamber side can be realized.

According to this liquid ejecting method, it is possible to optimize the amount of liquid ejected from the nozzles and the amount of liquid supplied to the pressure chamber. Accordingly, it is possible to improve the shortage of the supply of the liquid to the pressure chamber and to stabilize the ejection of the liquid.

In the liquid ejecting method, the opening area of the nozzles on the side in which the liquid is ejected may be 1/20 or more of the opening area of the opening of the supply unit.

According to this liquid ejecting method, it is possible to stabilize the ejection of the liquid.

In the liquid ejecting method, the length of the nozzles may be in a range from 40 μm to 100 μm.

According to this liquid ejecting method, it is possible to stabilize the ejection of the liquid.

In the liquid ejecting method, the opening of the supply unit may have a rectangular shape, the length of one side of the opening may be in a range from 30 μm to 500 μm, and the length of the other side of the opening may be in a range from 20 μm to 300 μm.

According to this liquid ejecting method, it is possible to supply the liquid having viscosity in a range from 6 mPa·s to 20 mPa·s to the pressure chamber with certainty.

In the liquid ejecting method, the outer edge of the opening of the supply unit may be smaller than that of the surface partitioning the pressure chamber and communicating with the supply unit.

According to this liquid ejecting method, it is possible to attenuate the pressure vibration applied to the liquid in the supply unit. Accordingly, it is possible to increase the ejection frequency of the liquid.

In the liquid ejecting method, the inertance of the nozzles may be smaller than that of the supply unit.

According to this liquid ejecting method, it is possible to efficiently eject the liquid by the pressure vibration applied to the liquid.

In the liquid ejecting method, the pressure chamber may have a partitioning portion which partitions a portion of the pressure chamber and applies the pressure variation to the liquid by deformation.

According to this liquid ejecting method, it is possible to efficiently apply the pressure variation to the liquid contained in the pressure chamber.

In the liquid ejecting method, the liquid ejecting head may include an element which deforms the partitioning portion by the degree according to a potential variation pattern of an applied ejection pulse.

According to this liquid ejecting method, it is possible to control the pressure of the liquid contained in the pressure chamber with high accuracy.

In addition, it will become apparent that the following liquid ejecting head can be realized.

That is, it will become apparent that a liquid ejecting head including: nozzles which eject the liquid; a pressure chamber which applies a pressure variation to the liquid in order to eject the liquid from the nozzles; and a supply unit which communicates with the pressure chamber and supplies the liquid to the pressure chamber, wherein the opening area of the nozzles on the side in which the liquid is ejected is 1/10 or less of the opening area of the opening of the supply unit on the pressure chamber side can be realized.

In addition, it will become apparent that the following liquid ejecting apparatus can be realized.

That is, it will become apparent that a liquid ejecting apparatus including: an ejection pulse generation unit which generates an ejection pulse; and a liquid ejection head which ejects a liquid from nozzles and includes: a pressure chamber which deforms a partitioning portion and applies a pressure variation to the liquid in order to eject the liquid from the nozzles; an element which deforms the partitioning portion by the degree according to a potential variation pattern of an applied ejection pulse; and a supply unit which communicates with the pressure chamber and supplies the liquid to the pressure chamber, wherein the opening area of the nozzles on the side in which the liquid is ejected is 1/10 or less of the opening area of the opening of the supply unit on the pressure chamber side can be realized.

First Embodiment

Printing System

The printing system shown in FIG. 1 includes a printer 1 and a computer CP. The printer 1 corresponds to a liquid ejecting apparatus, which ejects an ink, which is a liquid, onto a medium such as paper, cloth, or a film. The medium is an object onto which the liquid is ejected. The computer CP is connected to and is communicated with the printer 1. In order to print an image by the printer 1, the computer CP transmits printing data according to the image to the printer 1.

Outline of Printer 1

The printer 1 includes a sheet transportation mechanism 10, a carriage movement mechanism 20, a driving signal generation circuit 30, a head unit 40, a detector group 50 and a printer controller 60.

The sheet transportation mechanism 10 transports a sheet in a transportation direction. The carriage movement mechanism 20 moves a carriage, in which the head unit 40 is mounted, in a predetermined movement direction (for example, a paper width direction). The driving signal generation circuit 30 generates a driving signal COM. This driving signal COM is applied to a head HD (piezo-element 433, see FIG. 2A) at the time of printing of the sheet, and is a series of signals including ejection pulses PS like an example of FIG. 4. The ejection pulses PS allow the piezo-element 433 to perform a predetermined operation in order to eject a droplet-shaped ink from the head HD. Since the driving signal COM includes the ejection pulses PS, the driving signal generation circuit 30 corresponds to an ejection pulse generation unit. In addition, the configuration of the driving signal generation circuit 30 or the ejection pulses PS will be described later. The head unit 40 includes the head HD and a head controller HC. The head HD is a liquid ejection head, which ejects an ink onto a sheet. The head controller HC controls the head HD on the basis of a head control signal from the printer controller 60. In addition, the head HD will be described later. The detector group 50 includes a plurality of detectors for monitoring the status of the printer 1. The detected result of the detectors is output to the printer controller 60. The printer controller 60 performs the whole control of the printer 1. This printer controller 60 will be described later.

Main Portions of Printer 1

Head HD

Figure 2A:
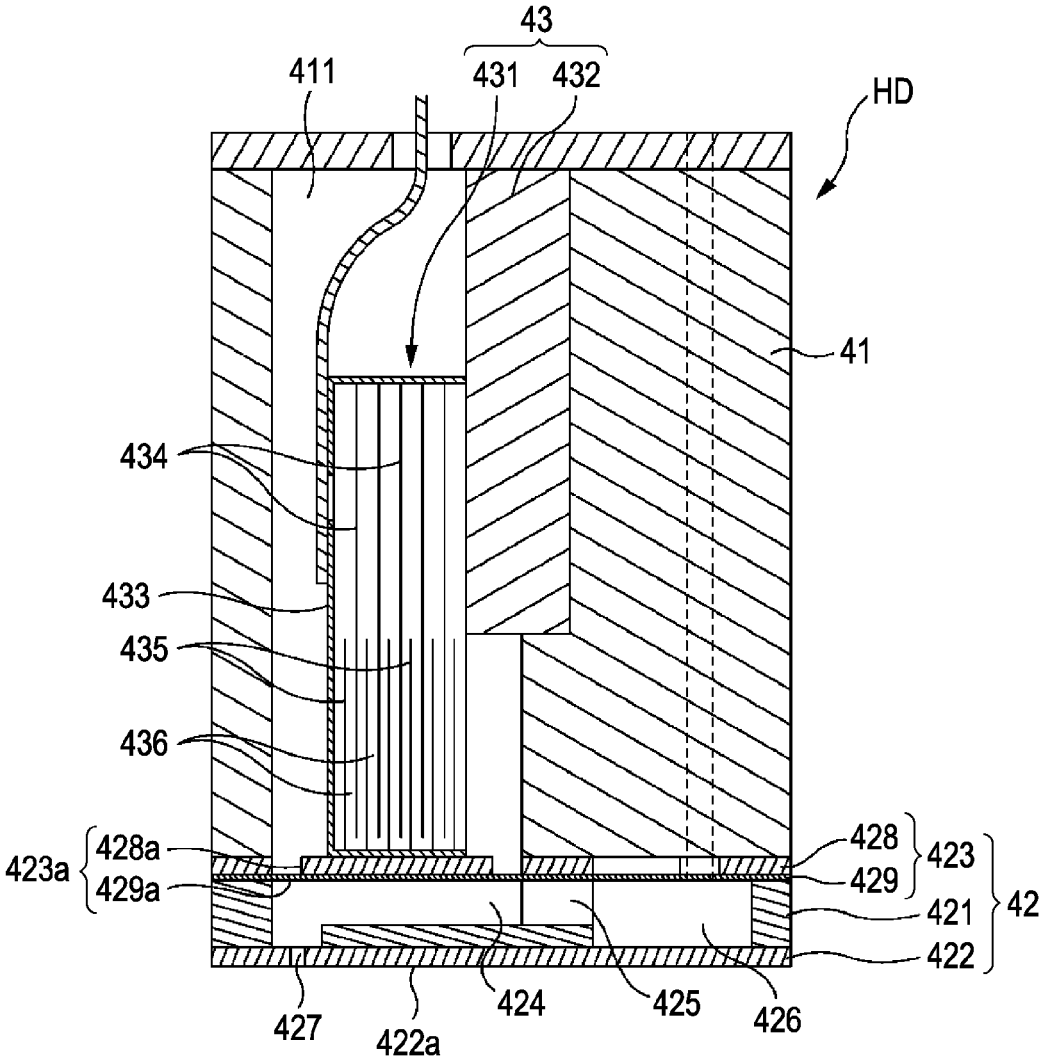
FIG. 2A is a cross-sectional view of a head.

As shown in FIG. 2A, the head HD includes a case 41, a channel unit 42, and a piezo-element unit 43. The case 41 is a member in which a storage space 411 for storing and fixing the piezo-element unit 43 is provided. The case 41 is formed of, for example, resin. In addition, the channel unit 42 is adhered to a front end surface of the case 41.

The channel unit 42 includes a channel forming substrate 421, a nozzle plate 422 and a vibration plate 423. In addition, the nozzle plate 422 is adhered to one surface of the channel forming substrate 421 and the vibration plate 423 is adhered to the other surface of the channel forming substrate. A groove which becomes a pressure chamber 424, a groove which becomes an ink supply path 425 and an opening which becomes a common ink chamber 426 are formed in the channel forming substrate 421. This channel forming substrate 421 is formed of, for example, a silicon substrate. The pressure chamber 424 is formed as a chamber which is elongated in a direction perpendicular to the arrangement direction of nozzles 427. The ink supply path 425 allows the pressure chamber 424 to communicate with the common ink chamber 426. This ink supply path 425 supplies an ink (a liquid) stored in the common ink chamber 426 to the pressure chamber 424. Accordingly, the ink supply path 425 is a supply unit for supplying the liquid to the pressure chamber 424. The common ink chamber 426 is a portion for temporarily storing the ink supplied from an ink cartridge (not shown) and corresponds to a common liquid storage chamber.

In the nozzle plate 422, the plurality of nozzles 427 is provided at a predetermined interval in the predetermined arrangement direction. The ink is ejected from the head HD via the nozzles 427. This nozzle plate 422 is formed of, for example, a stainless plate or a silicon substrate.

The vibration plate 423 has, for example, a double structure in which an elastic film 429 made of resin is laminated on a support plate 428 made of stainless. In the portion of the vibration plate 423 corresponding to the pressure chamber 424, the support plate 428 is etched in an annular shape. An island portion 428*a* is formed in the annular portion. The island portion 428*a* and the elastic film 429*a* located around the island portion configure a diaphragm portion 423*a*. This diaphragm portion 423*a* is deformed by the piezo-element 433 of the piezo-element unit 43 and varies the volume of the pressure chamber 424. That is, the diaphragm portion 423*a* partitions a portion of the pressure chamber 424 and corresponds to a partitioning portion for applying a pressure variation to the ink (liquid) in the pressure chamber 424 by the deformation.

The piezo-element unit 43 includes a piezo-element group 431 and a fixed plate 432. The piezo-element group 431 has a comb tooth-like shape. One comb tooth is the piezo-element 433. The front end surface of the piezo-element 433 is adhered to the island portion 428*a* corresponding thereto. The fixed plate 432 supports the piezo-element group 431 and becomes a mounting unit of the case 41. This fixed plate 432 is formed of, for example, a stainless plate and is adhered to the inner wall of the storage space 411.

The piezo-element 433 is an electromechanical conversion element and corresponds to an element which performs an operation (deformation operation) for applying a pressure variation to the liquid in the pressure chamber 424. The piezo-element 433 shown in FIG. 2A expands and contracts in an element's longitudinal direction perpendicular to a lamination direction by applying a potential difference between neighboring electrodes. That is, the electrodes include a common electrode 434 having a predetermined potential and a driving electrode 435 having a potential according to the driving signal COM (ejection pulses PS). In addition, a piezoelectric body 436 sandwiched between the electrodes 434 and 435 is deformed by the degree according to the potential difference between the common electrode 434 and the driving electrode 435. The piezo-element 433 expands and contracts in the element's longitudinal direction by the deformation of the piezoelectric body 436. In the present embodiment, the common electrode 434 has a ground potential or a bias potential higher than the ground potential by a predetermined potential. The piezo-element 433 contracts as the potential of the driving electrode 435 becomes higher than that of the common electrode 434. In contrast, the piezo-element expands as the potential of the driving electrode 435 becomes close to that of the common electrode 434 or becomes lower than that of the common electrode 434.

As described above, the piezo-element unit 43 is mounted in the case 41 via the fixed plate 432. If the piezo-element 433 contracts, the diaphragm portion 423*a* is pulled to be separated from the pressure chamber 424. Accordingly, the pressure chamber 424 expands. In contrast, if the piezo-element 433 expands, the diaphragm portion 423*a* is pulled to the side of the pressure chamber 424. Accordingly, the pressure chamber 424 contracts. The pressure variation occurs in the ink contained in the pressure chamber 424 due to the expansion or the contraction of the pressure chamber 424. That is, the ink contained in the pressure chamber 424 is pressurized by the contraction of the pressure chamber 424 and the ink contained in the pressure chamber 424 is depressurized by the expansion of the pressure chamber 424. Since the expansion and the contraction of the piezo-element 433 are determined by the potential of the driving electrode 435, the volume of the pressure chamber 424 is also determined by the potential of the driving electrode 435. Accordingly, the piezo-element 433 is an element for deforming the diaphragm portion 423*a* (partitioning portion) by the degree according to the potential variation pattern of the applied ejection pulses PS. In addition, the pressurized degree or the depressurized degree of the ink contained in the pressure chamber 424 may be determined by a potential variation of the driving electrode 435 per unit time.

Ink Channel

Figure 2B:
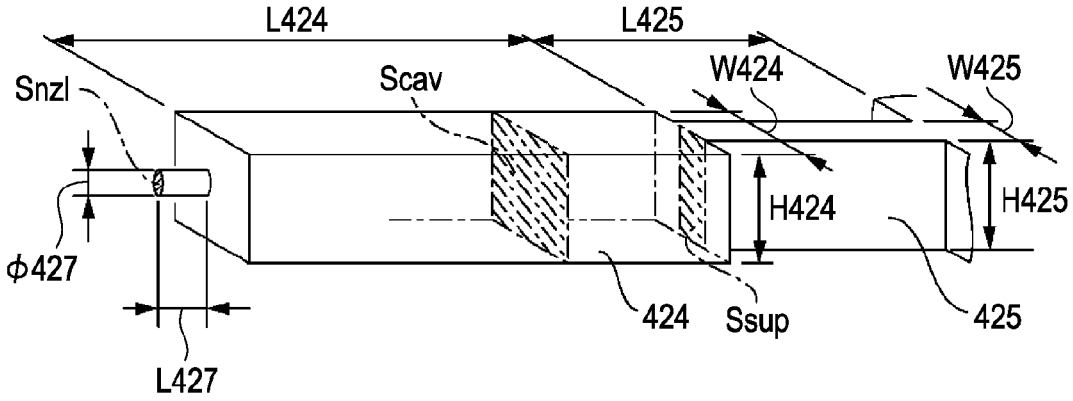
FIG. 2B is a schematic view explaining the structure of the head.

In the head HD, a plurality of ink channels (corresponding to a liquid channel in which the liquid is filled) which extends from the common ink chamber 426 to the nozzles 427 is formed according to the number of nozzles 427. In the ink channels, the thin nozzles 427 and the ink supply path 425 communicate with the thick pressure chamber 424. Accordingly, if the characteristic of the ink, such as the flow of the ink, is analyzed, the viewpoint of a Helmholtz resonator is applied. FIG. 2B is a schematic view explaining the structure of the head HD based on this viewpoint.

In the general head HD, the length L424 of the pressure chamber 424 is determined in a range from 200 μm to 2000 μm. The width W424 of the pressure chamber 424 is determined in a range from 20 μm to 300 μm, and the height H424 of the pressure chamber 424 is determined in a range from 30 μm to 500 μm. In addition, the length L425 of the ink supply path 425 is determined in a range from 50 μm to 2000 μm. The width W425 of the ink supply path 425 is determined in a range from 20 μm to 300 μm, and the height H425 of the ink supply path 425 is determined in a range from 30 μm to 500 μm. In addition, the diameter ϕ427 of the nozzles 427 is determined in a range from 10 μm to 40 μm and the length L427 of the nozzles 427 is determined in a range from 40 μm to 100 μm.

The width W425 or the height H425 of the ink supply path 425 is set to equal to or less than the width W424 or the height H424 of the pressure chamber 424. If one of the width W425 or the height H425 of the ink supply path 425 is aligned with one of the width W424 or the height H424 of the pressure chamber 424, the other of the width W425 or the height H425 of the ink supply path 425 is set to the other of the width W424 or the height H424 of the pressure chamber 424.

FIG. 2B is a schematic view explaining the ink channel. Accordingly, the ink channel has a shape different from an actual shape. However, the ink supply path 425 is actually configured as a rectangular parallelepiped space having a rectangular opening. Accordingly, the size of the opening of the ink supply path 425 is set to be smaller than that of the outer edge of the surface communicating with the ink supply path 425 as the surface partitioning the pressure chamber 424.

In such an ink channel, by applying the pressure variation to the ink contained in the pressure chamber 424, the ink is ejected from the nozzles 427. At this time, the pressure chamber 424, the ink supply path 425 and the nozzles 427 function as the Helmholtz resonator. Accordingly, if the pressure is applied to the ink contained in the pressure chamber 424, the level of this pressure varies in an inherent period called a Helmholtz period. That is, a pressure vibration occurs in the ink.

The Helmholtz period (inherent vibration period of the ink) Tc may be expressed by following Equation (1).

$$Tc=1/f$$

$$f=\tfrac{1}{2}\pi\sqrt{[(Mn+Ms)/(Mn\times Ms\times(Cc+ci))]} \quad (1)$$

In Equation (1), Mn denotes the inertance of the nozzles 427 (the mass of the ink per unit cross-sectional area, which will be described later), Ms denotes the inertance of the ink supply path 425, the Cc denotes the compliance (a volume variation per unit pressure and a degree of softness) of the pressure chamber 424, and Ci denotes the compliance of the ink (Ci=volume V/[density ρ×sound velocity $c_2$]).

The amplitude of the pressure vibration is gradually decreased as the ink flows in the ink channel. For example, the pressure vibration attenuates due to the loss of the nozzles 427 or the ink supply path 425 and the loss of the wall portion partitioning the pressure chamber 424.

In the general head HD, the Helmholtz period of the pressure chamber 424 is determined in a range from 5 μs to 10 μs. For example, in the ink channel of FIG. 2B, if the width W424 of the pressure chamber 424 is 100 μm, the height H424 thereof is 70 μm, and the length L424 thereof is 1000 μm, the width W425 of the ink supply path 425 is 50 μm, the height H425 thereof is 70 μm, and the length L425 thereof is 500 μm, and the diameter ϕ427 of the nozzles 427 is 30 μm and the length L427 thereof is 100 μm, the Helmholtz period becomes about 8 μs. In addition, the Helmholtz period varies according to the thickness of the wall portion partitioning the neighboring pressure chambers 424, the thickness or the compliance of the elastic film 429, or the material of the channel forming substrate 421 or the nozzle plate 422.

Printer Controller 60

The printer controller 60 performs the whole control of the printer 1. For example, the printer controller controls control objects on the basis of the detected result of the detectors or the printing data received from the computer CP and prints the image on the sheet. As shown in FIG. 1, the printer controller 60 includes an interface 61, a CPU 62 and a memory 63. The interface 61 transmits or receives data to or from the computer CP. The CPU 62 performs the whole control of the printer 1. The memory 63 ensures an area for storing a computer program, a working area or the like. The CPU 62 controls the control objects according to the computer program stored in the memory 63. For example, the CPU 62 controls the sheet transportation mechanism 10 or the carriage movement mechanism 20. In addition, the CPU 62 transmits a head control signal for controlling the operation of the head HD to the head controller HC or transmits a control signal for generating the driving signal COM to the driving signal generation circuit 30.

The control signal for generating the driving signal COM is also called DAC data and is, for example, plural-bit digital data. This DAC data decides the variation pattern of the potential of the generated driving signal COM. Accordingly, this DAC data is called data representing the potential of the ejection pulses PS or the driving signal COM. This DAC data is stored in a predetermined area of the memory 63, is read at the time of the generation of the driving signal COM, and is output to the driving signal generation circuit 30.

Driving Signal Generation Circuit 30

Figure 3:
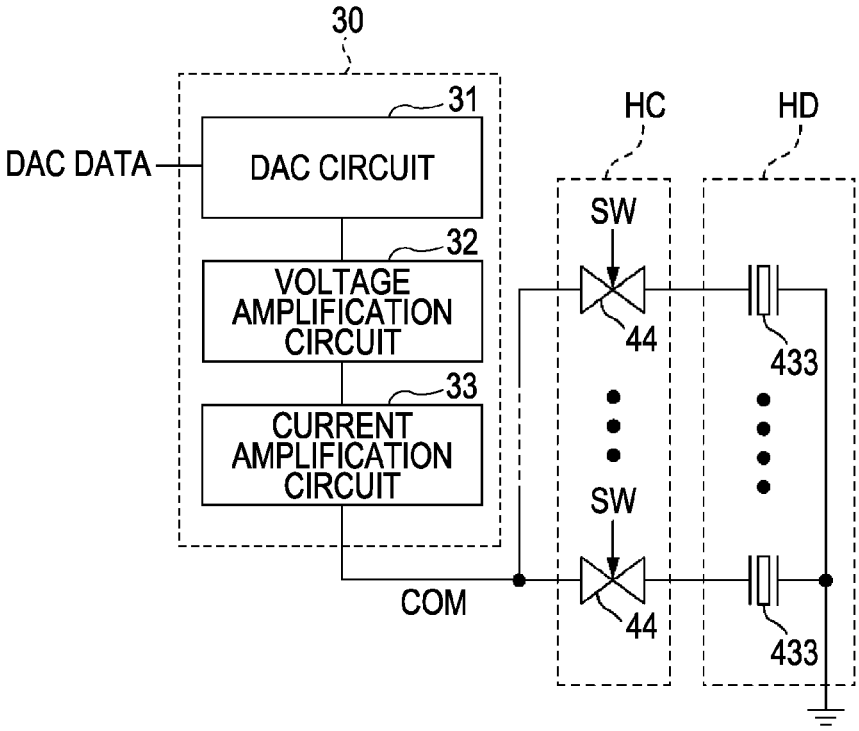

The driving signal generation circuit 30 functions as an ejection pulse generation unit and generates the driving signal COM having the ejection pulses PS on the basis of the DAC data. As shown in FIG. 3, the driving signal generation circuit 30 includes a DAC circuit 31, a voltage amplification circuit 32, and a current amplification circuit 33. The DAC circuit 31 converts digital DAC data into an analog signal. The voltage amplification circuit 32 amplifies the voltage of the analog signal converted by the DAC circuit 31 to a level for driving the piezo-element 433. In this printer 1, while the analog signal output from the DAC circuit 31 has 3.3 V at the maximum, the analog signal (for convenience, also called a waveform signal) after the amplification output from the voltage amplification circuit 32 is 42 V at the maximum. The current amplification circuit 33 amplifies the current with respect to the waveform signal from the voltage amplification circuit 32 and outputs the driving signal COM. This current amplification circuit 33 is, for example, composed of a pair of transistors push-pull connected to each other.

Head Controller HC

The head controller HC selects a necessary portion of the driving signal COM generated by the driving signal generation circuit 30 on the basis of the head control signal and applies the necessary portion to the piezo-element 433. Accordingly, as shown in FIG. 3, the head controller HC includes a plurality of switches 44 respectively provided in the piezo-elements 433 midway the supply line of the driving signal COM. In addition, the head controller HC generates a switch control signal from the head control signal. By controlling the switches 44 by the switch control signal, the necessary portion (for example, the ejection pulses PS) of the driving signal COM is applied to the piezo-element 433. At this time, the ejection of the ink from the nozzles 427 can be controlled by the selection method of the necessary portion.

Driving Signal COM

Figure 4:
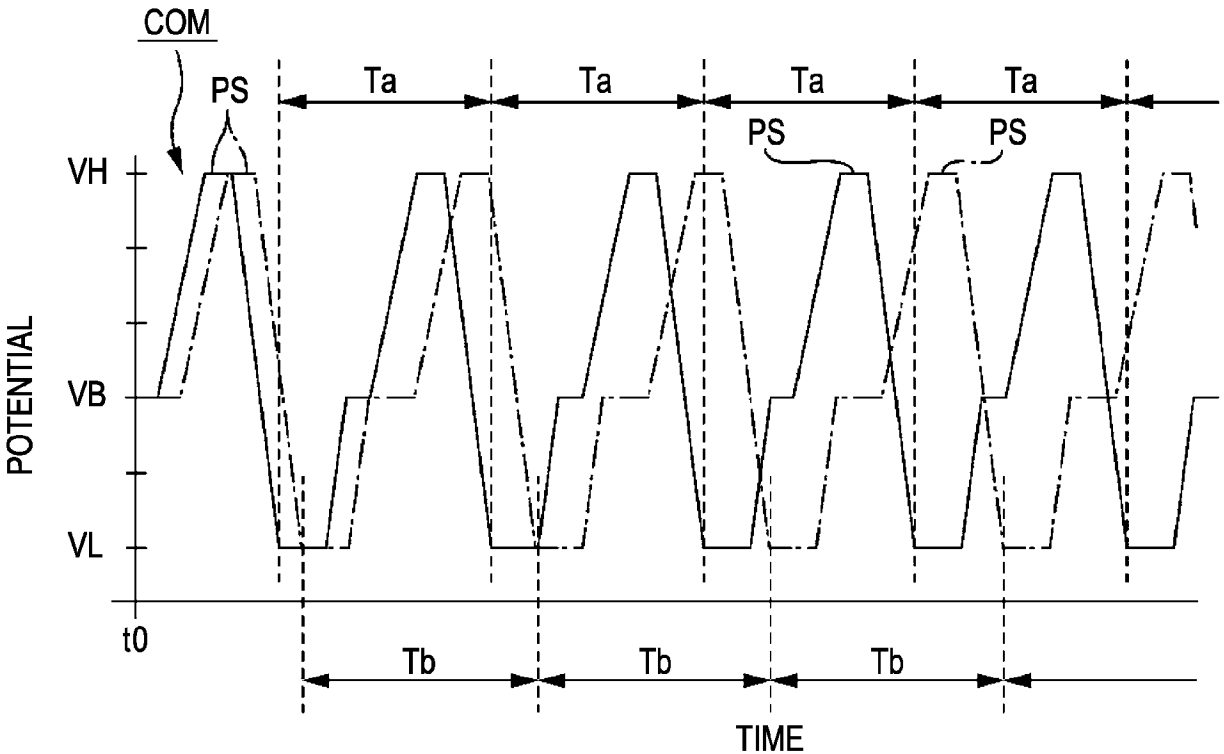
FIG. 4 is a view explaining an example of a driving signal.

Next, the driving signal COM generated by the driving signal generation circuit 30 will be described. As shown in FIG. 4, the plurality of ejection pulses PS which is repeatedly generated is included in the driving signal COM. Such ejection pulses PS have the same waveform, that is, have the same potential variation pattern. As described above, this driving signal COM is applied to the driving electrode 435 of the piezo-element 433. Accordingly, a potential difference according to the potential variation pattern occurs between the driving electrode and the common electrode 434 having a fixed potential. As a result, each of the piezo-element 433 expands and contracts according to the potential variation pattern and the volume of the pressure chamber 424 varies.

The potential of each ejection pulse PS shown rises from a medium potential VB as a reference potential to a highest potential VH and then falls to a lowest potential VL. Then, the potential of each ejection pulse rises to the intermediate potential VB. As described above, the piezo-element 433 contracts as the potential of the driving electrode 435 is higher than that of the common electrode 434, and the volume of the pressure chamber 424 is increased.

Accordingly, if the ejection pulses PS are applied to the piezo-element 433, the pressure chamber 424 expands from a reference volume corresponding to the intermediate potential VB to a maximum volume corresponding to a highest potential VH. Thereafter, the pressure chamber 424 contracts to a minimum volume corresponding to the lowest potential VL and expands to the reference volume. When the pressure chamber contracts from the maximum volume to the minimum volume, the ink contained in the pressure chamber 424 is pressurized and ink droplets are ejected from the nozzles 427. Accordingly, the portion of each ejection pulse PS which varies from the highest potential VH to the lowest potential VL corresponds to the ejection portion for ejecting the ink.

The ejection frequency of the ink droplet is determined by the interval between the ejection portions which are generated in tandem. For example, in the example of FIG. 4, the ink droplet is ejected in every period Ta in the driving signal COM denoted by a solid line and the ink droplet is ejected in every period Tb in the driving signal COM denoted by a dashed-dotted line. Accordingly, the ejection frequency according to the driving signal COM denoted by the solid line is higher than the ejection frequency according to the driving signal COM denoted by the dashed-dotted line.

Ejecting Operation

Outline

Figure 5A:
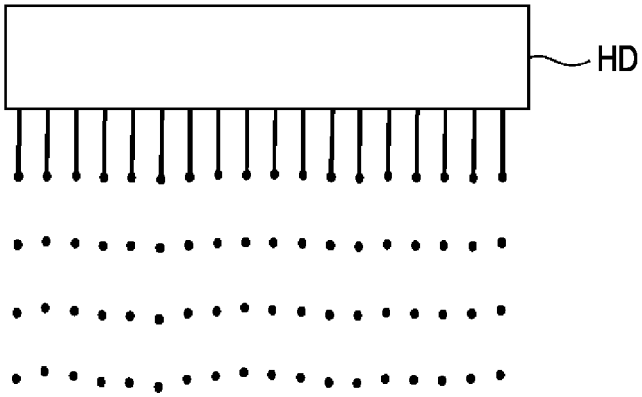
FIG. 5A is a view showing the case where an ink having high viscosity is ejected in a stable state.
Figure 5B:
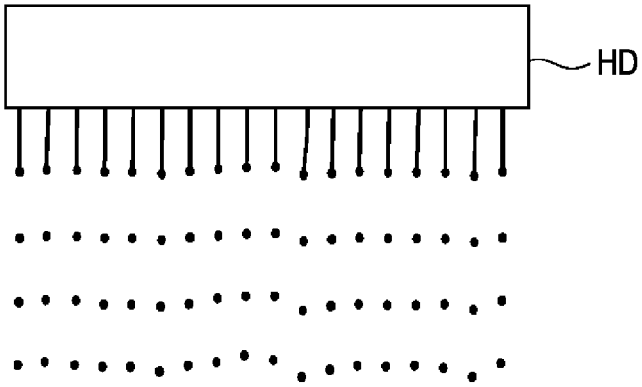
FIG. 5B is a view showing the case where the ink having high viscosity is ejected in an unstable state.

In this type of printer, there is a need for stabilizing the ejection of the ink. For example, when the ink droplet is ejected with a low frequency and when the ink droplet is ejected with a high frequency, there is a need for equalizing the amount of ink droplet, a flight direction or a flying speed. However, when an ink having viscosity which is sufficiently higher than the viscosity (about 1 mPa·s) of a general ink and, more particularly, an ink having viscosity of 6 to 20 mPa·s (for convenience, also called a high-viscosity ink) is ejected by the existing head, the ejection of the ink becomes unstable. FIG. 5A is a view showing the case where an ink having high viscosity is ejected in a stable state. FIG. 5B is a view showing the case where the ink having high viscosity is ejected in an unstable state. When these drawings are compared, an ink droplet having an insufficient flying speed or an ink droplet, in which ejection deflection occurs, exists in the unstable state.

Various factors for making the ejection of the ink unstable may be considered, but, among them, the shortage of the supply of the ink is considered as one factor. The high-viscosity ink is hard to pass through the ink supply path 425 compared with a general ink. Accordingly, when the supply of the ink to the pressure chamber 424 is insufficient and the operation for ejecting the ink is performed in a state in which the ink is insufficient, the ejection of the inks becomes unstable.

In the light of these circumstances, in the head HD of the present embodiment, the opening area of the nozzles 427 is set on the basis of the opening area of the ink supply path 425. That is, as shown in FIG. 2B, the opening area Snzl of the nozzles 427 on the ejection side is 1/10 or less of the opening area Ssup of the ink supply path 425 on the side of the pressure chamber 424. Accordingly, the supply amount of the ink to the pressure chamber 424 is ensured while the ejection amount of the ink droplets from the nozzles 427 is restricted. As a result, the shortage of the supply of the ink to the pressure chamber 424 can be solved and the ejection of the ink can be stabilized. Hereinafter, this will be described in detail.

Ejection Pulse PS

Figure 6:
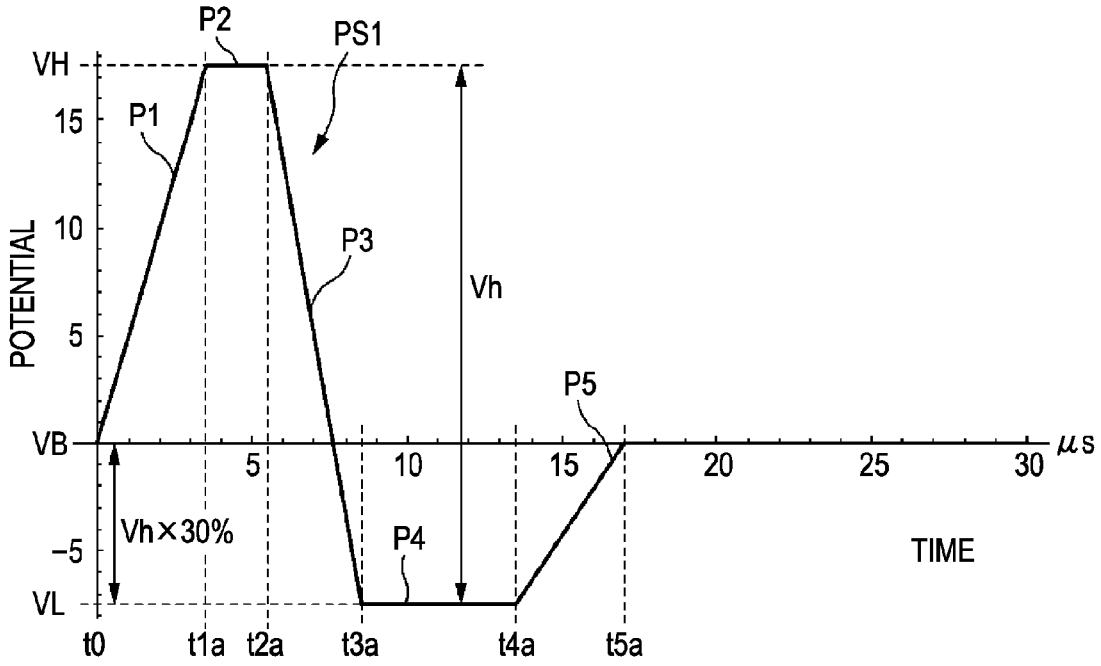
FIG. 6 is a view explaining an ejection pulse used in evaluation.

First, each of the ejection pulses PS used in evaluation will be described. FIG. 6 is a view explaining an ejection pulse PS1. In addition, in FIG. 6, a vertical axis denotes the potential of the driving signal, and an intermediate potential VB as a reference potential is 0 V. In addition, a horizontal axis denotes a time.

The ejection pulse PS1 shown in FIG. 6 has a plurality of portions denoted by reference numerals P1 to P5. That is, the ejection pulse PS1 includes a first depressurization portion P1, a first potential holding portion P2, a pressurization portion P3, a second potential holding portion P4, and a second depressurization portion P5.

The first depressurization portion P1 is a portion generated from a timing t0 to a timing t1*a*. In this first depressurization portion P1, the potential of the timing t0 (corresponds to a start potential) is the intermediate potential VB and the potential of the timing t1*a* (corresponding to an end potential) is the highest potential VH. Accordingly, if the first depressurization portion P1 is applied to the piezo-element 433, the pressure chamber 424 expands from the reference volume to the maximum volume in the generation period of the first depressurization portion P1.

The intermediate potential VB of the ejection pulse PS1 is set to a potential higher than the lowest potential VL of the ejection pulse PS1 by 30% of a difference (hereinafter, referred to as a driving voltage Vh) from the highest potential VH to the lowest potential VL. In addition, the driving voltage Vh of the ejection pulse PS1 is 25 V. Accordingly, the intermediate potential VB is higher than the lowest potential VL by 7.5 V, and the highest potential VH is higher than the intermediate potential VB by 17.5. In addition, the generation period of the first depressurization portion P1 is 3.5 μs.

The first potential holding portion P2 is a portion generated from the timing t1*a* to a timing t2*a*. This first potential holding portion P2 is held at the highest potential VH. Accordingly, if the first potential holding portion P2 is applied to the piezo-element 433, the pressure chamber 424 holds the maximum volume in the generation period of the first potential holding portion P2. In this ejection pulse PS1, the generation period of the first potential holding portion P2 is 2 μs.

The pressurization portion P3 is a portion generated from the timing t2*a* to a timing t3*a*. In this pressurization portion P3, a start potential is the highest potential VH and an end potential is the lowest potential VL. Accordingly, if the pressurization portion P3 is applied to the piezo-element 433, the pressure chamber 424 contracts from the maximum volume to the minimum volume in the generation period of the pressurization portion P3. Since the ink is ejected by the contraction of this pressure chamber 424, the pressurization portion P3 corresponds to the ejection portion for ejecting the ink droplet. In this ejection pulse PS1, the generation period of the pressurization portion P3 is 3 μs.

The second potential holding portion P4 is a portion generated from the timing t3*a* to a timing t4*a*. This second potential holding portion P4 is held at the lowest potential VL. Accordingly, if the second potential holding portion P4 is applied to the piezo-element 433, the pressure chamber 424 holds the minimum volume in the generation period of the second potential holding portion P4. In this ejection pulse PS1, the generation period of the second potential holding portion P4 is 5 μs.

The second depressurization portion P5 is a portion generated from a timing t4*a* to a timing t5*a*. In this second depressurization portion P5, a start potential is the lowest potential VL and an end potential is the intermediate potential VB. Accordingly, if the second depressurization portion P5 is applied to the piezo-element 433, the pressure chamber 424 expands from the minimum volume to the reference volume in the generation period of the second depressurization portion P5. The second depressurization portion P5 allows the piezo-element 433 to perform an operation for expanding the pressure chamber 424 in the contraction state to the reference volume after the ejection of the ink droplets. In this ejection pulse PS1, the generation period of the second depressurization portion P5 is 3.5 μs.

Ink Having Viscosity of 20 mPa·s

Figure 7:
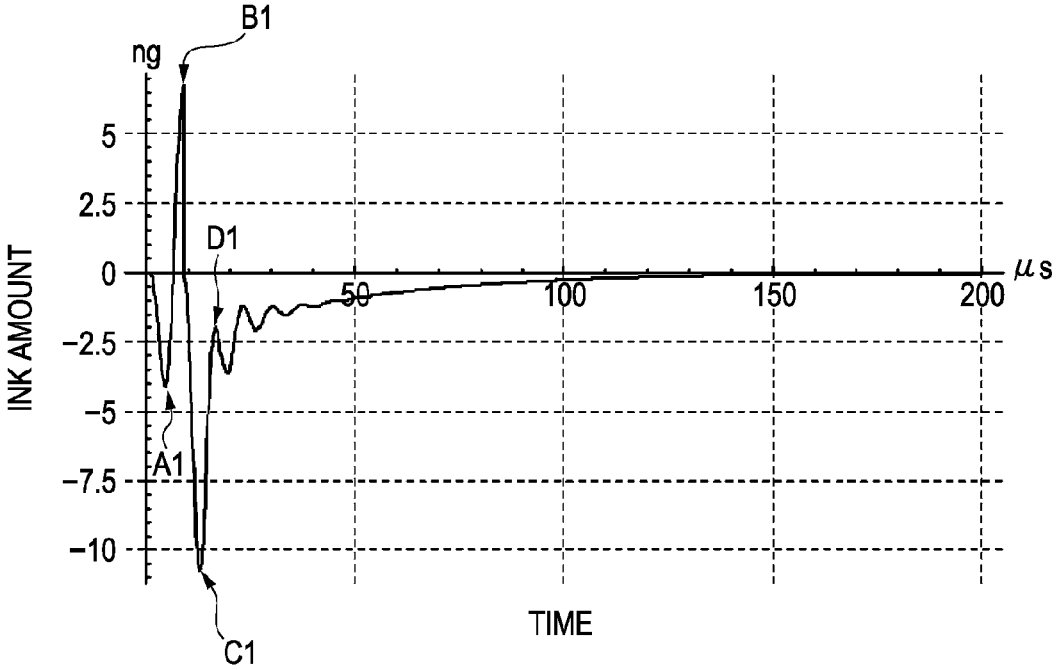
FIG. 7 is a view explaining the ejection of ink droplets by a head in which the opening area of nozzles is set to about 1/10 of the opening area of an ink supply path on a pressure chamber side.

FIG. 7 is a view explaining the ejection of ink droplets by a head HD in which the opening area Snzl of nozzles 427 is set to about 1/10 of the opening area Ssup of the ink supply path 425. As shown in FIG. 2B, the opening area Snzl is the area of the opening located at the side, in which the ink droplets are ejected, of the nozzles 427. The opening area Ssup is the area of the opening of the side, which communicates with the pressure chamber 424, of two openings of the ink supply path 425.

In FIG. 7, a vertical axis denotes the amount of ink in a meniscus (a free surface of the ink exposed by each of the nozzles 427) state and a horizontal axis denotes a time. In the vertical axis, 0 ng denotes the position of the meniscus in a normal state. As a value is increased in a positive side, the meniscus is pushed out in an ejection direction and, as a value is increased in a negative side, the meniscus is drawn into the side of the pressure chamber 424. FIG. 7 is obtained by a simulation. The other drawings explaining the ejection of the ink droplets are obtained by simulations.

In this head HD, the width W424 of the pressure chamber 424 is 100 μm, the height H424 thereof is 70 μm, and the length L424 is 1000 μm. The diameter ϕ427 of the nozzles 427 is 25 μm and the length of the nozzles 427 is 100 μm. The width W425 of the ink supply path 425 is 100 μm, the height H425 thereof is 55 μm, and the length L425 thereof is 500 μm. Accordingly, the opening area Snzl of the nozzles 427 becomes about 500 $\mu m^2$ (more accurately, 491 $\mu m^2$), and the opening area Ssup of the ink supply path 425 becomes 5500 $\mu m^2$. Accordingly, the opening area of the nozzles 427 is about 1/10 (more accurately 1/11) of the opening area of the ink supply path 425.

In the head HD having such an ink channel, when the ejection pulse PS1 of FIG. 6 is applied to the piezo-element 433, the ink droplets are ejected from the nozzles 427. At this time, the meniscus is moved as shown in FIG. 7. First, when the first depressurization portion P1 is applied to the piezo-element 433, the pressure chamber 424 expands from a reference volume to a maximum volume. By this expansion, the ink contained in the pressure chamber 424 is made a negative pressure and the ink is introduced into the side of the pressure chamber 424 via the ink supply path 425. In addition, by making the ink the negative pressure, the meniscus is drawn into the side of the pressure chamber 424 in the nozzles 427.

The movement of the meniscus to the pressure chamber 424 is continuously performed even after the applying of the first depressurization portion P1 is finished. That is, by compliance or the like of the vibration plate 423 or the wall portion partitioning the pressure chamber 424, the meniscus is moved to the side of the pressure chamber 424 even during the applying of the first potential holding portion P2. Thereafter, the movement direction of the meniscus is inverted in a direction which becomes distant from the pressure chamber 424 (a timing denoted by a reference numeral A1 of FIG. 7). At this time, since the contraction of the pressure chamber 424 is applied by the applying of the pressurization portion P3, the movement speed of the meniscus is rapid. The meniscus moved by the applying of the pressurization portion P3 has a columnar shape. Until the applying of the second potential holding portion P4 to the piezo-element 433 is finished, a portion of the front end side of the meniscus having the columnar shape is broken and the ink is ejected with a drop shape (a timing denoted by a reference numeral B1 of FIG. 7).

By reaction to the ejection, the meniscus is returned to the side of the pressure chamber 424 at a fast speed. At this time, the second depressurization portion P5 is applied to the piezo-element 433. By the applying of the second depressurization portion P5, the pressure chamber 424 expands. By this expansion, the ink contained in the pressure chamber 424 is made a negative pressure and the ink is introduced into the side of the pressure chamber 424 via the ink supply path 425.

After the second depressurization portion P5 is applied, the meniscus gradually becomes close to the position of the normal state (ink amount of 0 ng) while the movement direction thereof is switched to the ejection side and the side of the pressure chamber 424 (for example, timings denoted by reference numerals C1 and D1 of FIG. 7). The reason why the meniscus becomes close to the position of the normal state is because the ink contained in the pressure chamber 424 is increased. Accordingly, while the meniscus becomes close to the position of the normal state, the ink is supplied from the ink supply path 425 to the pressure chamber 424. The returning of the meniscus to the position of the normal state indicates that a sufficient amount of ink is supplied into the pressure chamber 424. Accordingly, when the ejection pulse PS1 is applied to the piezo-element 433 after this time point, it is possible to prevent an ink ejection failure due to the shortage of the supply of the ink. In the example of FIG. 7, the meniscus is substantially returned to the position of the normal state at a time point when 100 μs is elapsed from the start of the applying of the first depressurization portion P1 to the piezo-element 433.

In the present embodiment, the returning of the meniscus to the position of the normal state at the time point when 100 μs is elapsed from the start of the applying of the first depressurization portion P1 becomes a determination reference for performing the stable ejection even in a high frequency of 40 kHz or more. If only a time of 100 μs is considered, an ejection frequency becomes about 10 kHz as a maximum. However, if the ejection frequency is increased, since the ink droplets are sequentially ejected, the flow of the ink from the side of the common ink chamber 426 to the side of the nozzles 427 occurs in the ink channels (a series of channels from the common ink chamber 426 to the nozzles 427). This flow of the ink is accelerated as the ejection frequency is increased. Since the ink is supplied to the pressure chamber 424 by this flow, the determination reference is set.

As one of reasons why the meniscus is rapidly returned to the position of the normal state, there is a ratio of the opening area Snzl of the nozzles 427 to the opening area Ssup of the ink supply path 425. That is, in this head HD, the opening area Snzl of the nozzles 427 is set to about 1/10 of the opening area Ssup of the ink supply path 425. Accordingly, when the pressure of the ink contained in the pressure chamber 424 is changed, the ease of the flowing of the ink in the nozzles 427 is made different from that in the ink supply path 425. That is, the ink may more easily flow in the ink supply path 425 than in the nozzles 427. In addition, since the opening area Snzl of the nozzles 427 is sufficiently smaller than the opening area Ssup of the ink supply path 425, it is possible to suppress the ejection capability of the ink droplets.

Accordingly, when the ink contained in the pressure chamber 424 is depressurized, the ink is easily supplied from the ink supply path 425 to the pressure chamber 424 and the shortage of the supply of the ink is improved. This can be understood from that the meniscus is largely moved between the timing C1 and the timing D1 of FIG. 7. That is, the ink flows from the ink supply path 425 into the side of the pressure chamber 424 by the reaction in which the ink is largely depressurized at the timing C1 and the meniscus becomes close to the position of the normal state at the timing D1.

Figure 8:
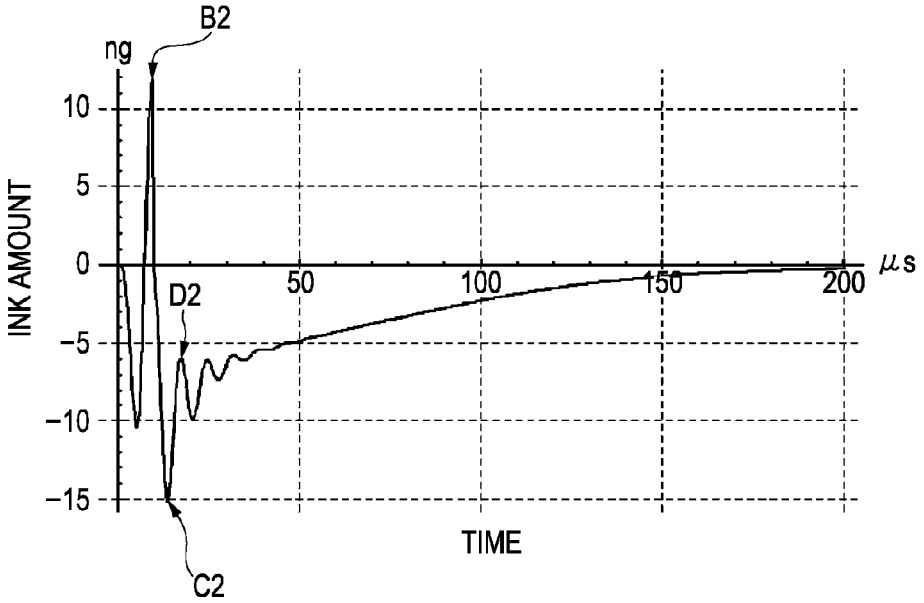
FIG. 8 is a view explaining the ejection of ink droplets by a head of a comparative example.

FIG. 8 is a view explaining the ejection of the ink droplets by a head HD of a comparative example. The head HD of the comparative example is different from the head HD used in FIG. 7 in that the opening area Snzl of the nozzles 427 is set to about 1/6.7 (ratio of 0.15) of the opening area Ssup of the ink supply path 425. From the comparison of FIGS. 8 and 7, it can be seen that the head HD of the comparative example ejects a larger amount of ink. That is, while the amount of ink at a timing B2 is 12 ng, the amount of ink at a timing B1 is 7 ng. It can be seen that the head HD of the comparative example is larger than the head HD used in FIG. 7 in the drawing amount of meniscus. That is, while the amount of ink at a timing C2 is −15 ng, the amount of ink at a timing C1 is −10.5 ng. This is because the ink more easily flows in the nozzles 427 in the head HD of the comparative example, compared with the head HD used in FIG. 7. From the sufficiently large drawing amount of meniscus, it can be seen that, even in the head HD of the comparative example, the ink contained in the pressure chamber 424 is sufficiently depressurized by the applying of the second depressurization portion P5 to the piezo-element 433.

However, after this depressurization, in the head HD of the comparative example, the returning amount of meniscus is smaller than that of the head HD used in FIG. 7. In detail, while the amount of ink at a timing D2 is −6 ng, the amount of ink at a timing D1 is −2 ng. As described above, the returning amount of meniscus is associated with the supply amount of ink to the pressure chamber 424. That is, as the ink is supplied to the pressure chamber 424, the meniscus becomes close to the position of the normal state. Accordingly, in the head HD used in FIG. 7, after the ejection of the ink droplets, a sufficient amount of ink is rapidly supplied to the pressure chamber 424 via the ink supply path 425. In contrast, in the head HD of the comparative example, after the ejection of the ink droplets, the amount of ink supplied to the pressure chamber 424 is smaller than that of the head HD used in FIG. 7. Accordingly, the time consumed for returning the meniscus to the position of the normal state is increased. This is because, in the head HD of the comparative example, the shortage of the supply of the ink easily occurs compared with the head HD used in FIG. 7.

Relationship with Area of Pressure Chamber 424

Next, the relationship between the area Scav of the pressure chamber 424 and the opening area Ssup of the ink supply path 425 will be described. As shown in FIG. 2B, the area Scav of the pressure chamber 424 is the cross-sectional area of the surface crossing the ink flowing direction, that is, the thickness of the pressure chamber 424. In the following description, if only the area Scav of the pressure chamber 424 is described, it indicates the cross-sectional area of the surface crossing the ink flowing direction.

Figure 9:
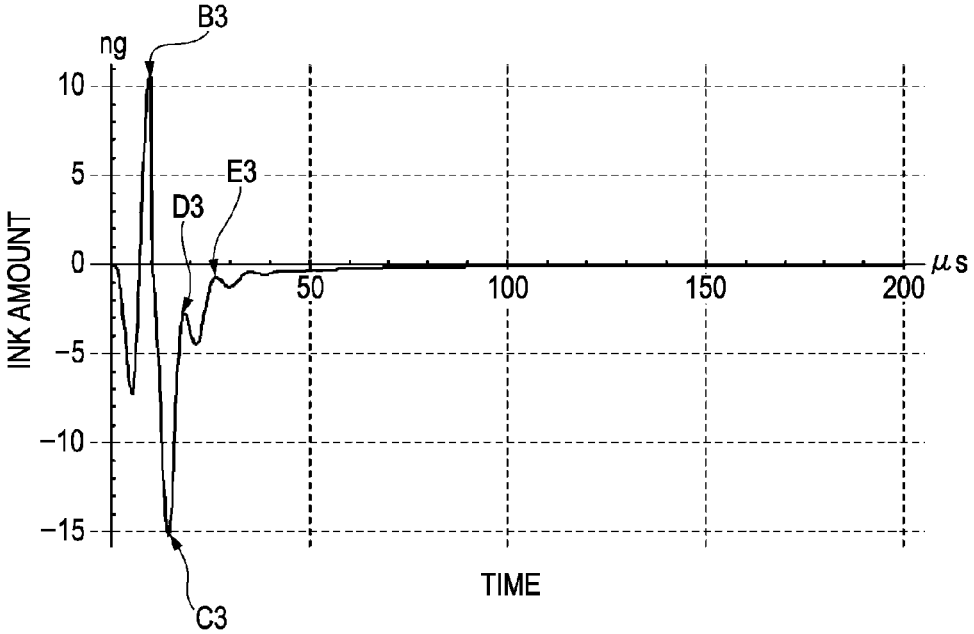
FIG. 9 is a view explaining the ejection of ink droplets by a head in which the opening area of the ink supply path is 0.34 times of the area of the pressure chamber.
Figure 10:
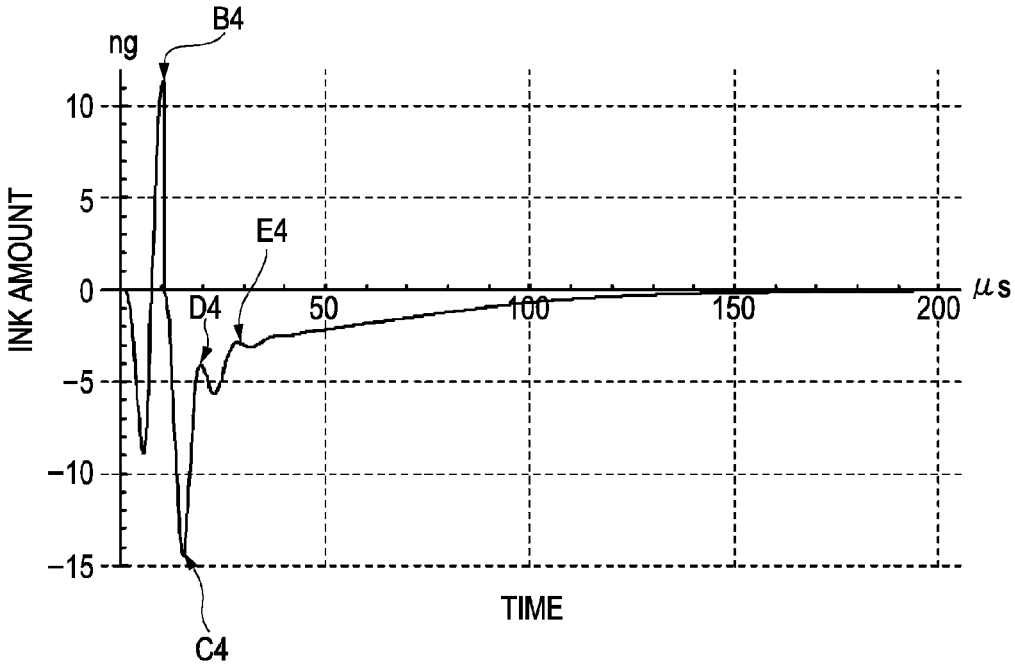
FIG. 10 is a view explaining the ejection of ink droplets by a head in which the opening area of the ink supply path is 0.32 times of the area of the pressure chamber 73.

FIG. 9 is a view explaining the ejection of ink droplets by a head HD in which the opening area Ssup of the ink supply path 425 is 0.34 times of the area Scav of the pressure chamber 424. FIG. 10 is a view explaining the ejection of ink droplets by a head HD in which the opening area of the ink supply path 425 is 0.32 times of the area of the pressure chamber 424. The head HD used in FIG. 9 satisfies a condition of Scav<3×Ssup and is the head of the boundary of this condition. In contrast, the head HD used in FIG. 10 does not satisfies of Scav<3×Ssup and is the head of the boundary of this condition. In these drawings, the viscosity of the ink to be ejected is 20 mPa·s.

When FIGS. 9 and 10 are compared, the head HD used in FIG. 9 and the head HD used in FIG. 10 are hardly different from each other in the movement of the meniscus until the ink droplets are ejected and the ink contained in the pressure chamber 424 is depressurized. For example, while the amount of ink at a timing B3 is 11 ng or less, the amount of ink at a timing B4 is 11 ng or more. While the amount of ink at a timing C3 is −15 ng or more, the amount of ink at a timing C4 is −15 ng or less.

However, these heads HD are different from each other in the method of returning the meniscus after the depressurization of the ink. For example, while the amount of ink at a timing D3 is −3 ng, the amount of ink at a timing D4 is −4 ng. In addition, while the amount of ink at a timing E3 is −1 ng, the amount of ink at a timing E4 is −3 ng. In the head HD used in FIG. 9, the time consumed for causing the meniscus to become close to the position of the normal state is shorter than that of the head HD used in FIG. 10. From this characteristic, it can be understood that, in the head HD used in FIG. 9, the supply amount of ink after the ejection of the ink droplets is larger than that of the head HD used in FIG. 10.

Accordingly, by using the head HD satisfying the condition of Scav<3×Ssup, the shortage of the supply of the ink to the pressure chamber 424 is hard to occur and the ejection stability of the ink having high viscosity can be further improved.

Discussion

From the above-described result, by setting the opening area Snzl of the nozzles 427 (the opening area of the side in which the ink droplets are ejected) to 1/10 or less of the opening area Ssup of the ink supply path 425 (the opening area of the side of the pressure chamber 424), it is possible to optimize the balance of the amount of ink supplied to the pressure chamber 424 and the amount of ink ejected from the nozzles 427 and to improve the shortage of the supply of the ink to the pressure chamber 424. As a result, it is possible to suppress the shortage of the supply of the ink even when the ink having high viscosity is used and stabilize the ejection of the ink droplets.

However, as described above, the opening area Snzl or the length L427 of the nozzles 427 and the opening area Ssup or the length L425 of the ink supply path 425 may have various values. By changing these values, it is possible to change the balance of the ease of the flowing of the ink at the side of the nozzles 427 and the ease of the flowing of the ink at the side of the ink supply path 425.

In consideration of the effect in which the shortage of the supply of the ink to the pressure chamber 424 is suppressed and the ejection is stabilized, if the shortage of the supply of the ink does not occur even although the ink is easiest to flow in the nozzles 427 and the ink is hardest to flow in the ink supply path 425 (worst state), the above-described effect can be obtained regardless of the other elements such as the length L427 of the nozzles 427 or the length L425 of the ink supply path 425.

Figure 11:
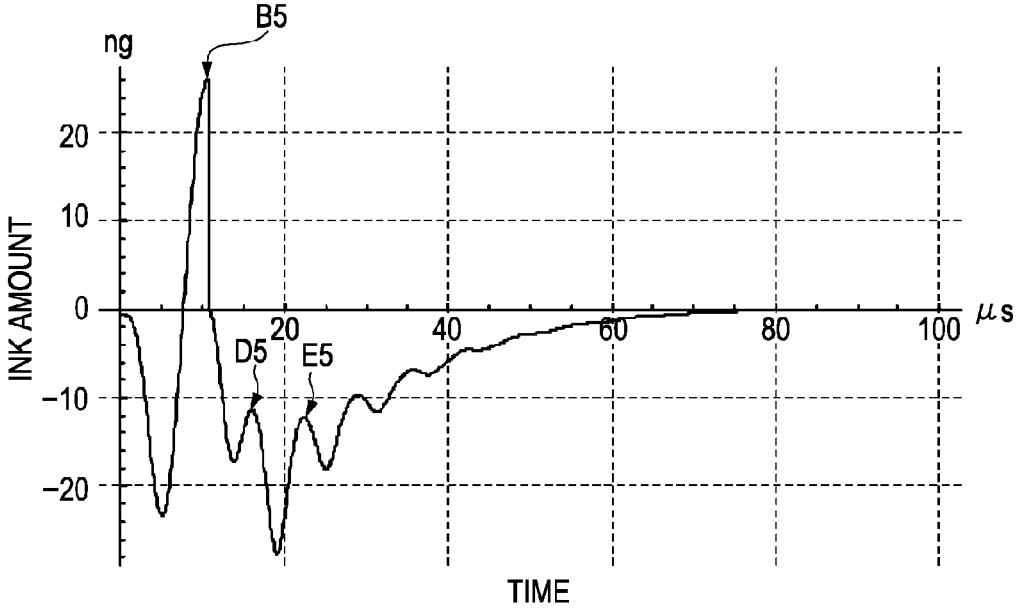
FIG. 11 is a view explaining the ejection of ink droplets by a head in a worst state.

On the basis of this viewpoint, in the worst state, a simulation was performed using the head HD in which the opening area Snzl of the nozzles 427 is set to 1/10 of the opening area Ssup of the ink supply path 425. FIG. 11 is a view explaining the ejection of ink droplets by a head HD in this simulation result, in the worst state.

The head HD used in FIG. 11, the diameter ϕ427 of the nozzles 427 is 50 μm (opening area Snzl: about 1963 $\mu m^2$), the length L427 of the nozzles 427 is 40 μm, the width W425 of the ink supply path 425 is 200 μm, the height H425 thereof is 100 μm (opening area Ssup: 20000 $\mu m^2$), and the length L425 of the ink supply path 425 is 2000 μm. In the pressure chamber 424, the width W424 is 300 μm, the height H424 is 100 μm, and the length L424 is 800 μm. That is, this head HD, the diameter ϕ427 of the nozzles 427 is largest, the length L427 of the nozzles 427 is shortest, the length L425 of the ink supply path 425 is longest, and the opening area Snzl of the nozzles 427 is substantially set to 1/10 of the opening area Ssup of the ink supply path 425. The viscosity of the ink to be ejected is 20 mPa·s.

In this head HD, the ejection amount of ink is larger than that of the above-described heads HD. That is, the amount of ink at a timing B5 is 30 ng. This is because the diameter ϕ427 of the nozzles 427 is set to a maximum value which may be used by the general head HD and the length L427 of the nozzles 427 is set to a minimum value which may be used by the general head HD.

At a timing D5 or a timing E5 after the ejection of the ink droplets, the amount of ink is about −11 ng, but, thereafter, the meniscus becomes to the position of the normal state and substantially returns to the position of the normal state at a timing after 75 μs is elapsed from the start of the applying of the first depressurization portion P1. From this, it can be seen that, after the ejection of the ink droplets, the ink is rapidly supplied to the pressure chamber 424. Accordingly, by setting the opening area Snzl of the nozzles 427 to 1/10 or less of the opening area Ssup of the ink supply path 425, it is possible to suppress the shortage of the supply of the ink to the pressure chamber 424 even when the ink having high viscosity is ejected and to stabilize the ejection of the ink droplets.

Difference in Viscosity

Figure 12:
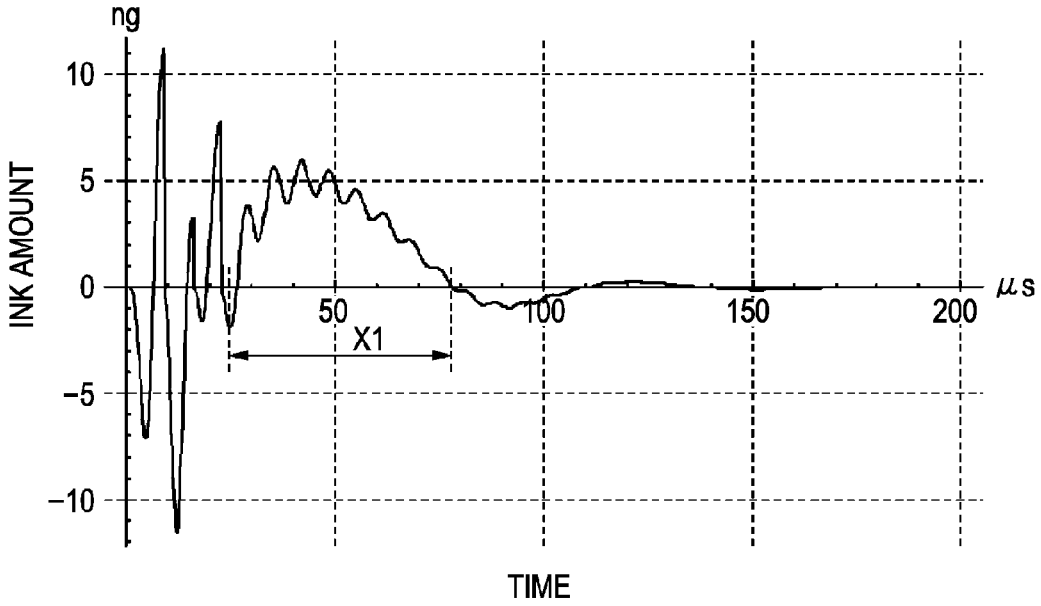
FIG. 12 is a view explaining the ejection of ink droplets when an ink having viscosity of 5 mPa·s is ejected.
Figure 13:
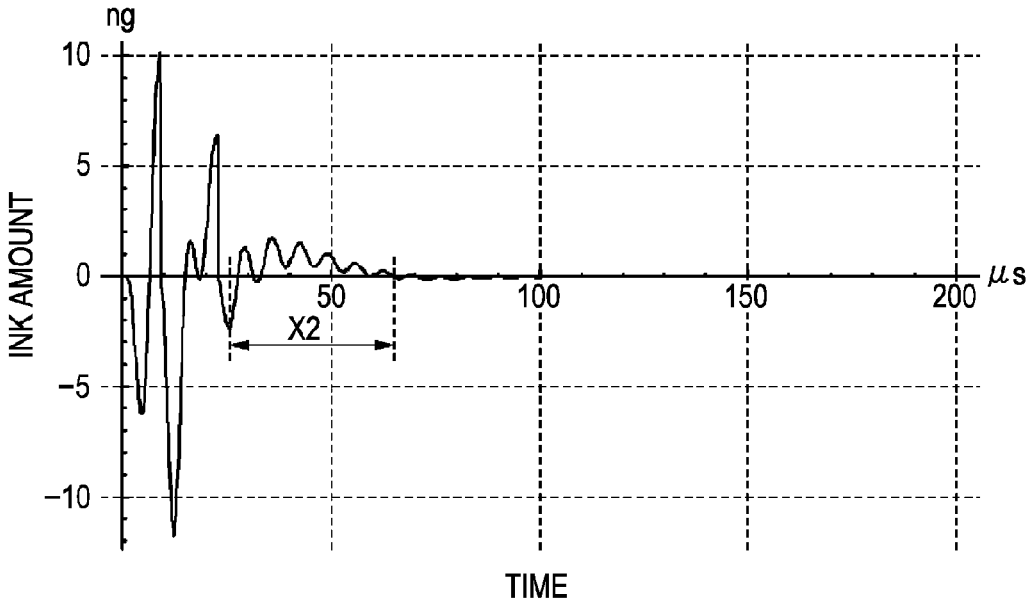
FIG. 13 is a view explaining the ejection of ink droplets when an ink having viscosity of 6 mPa·s is ejected.

The above-described embodiment is an experimental result (simulation result) of the ink having high viscosity of 20 mPa·s, but the viscosity of the ink having high viscosity has a width. Accordingly, the influence due to a difference in the viscosity of the ink will be described. FIG. 12 is a view explaining the ejection of ink droplets when an ink having viscosity of 5 mPa·s is ejected. FIG. 13 is a view explaining the ejection of ink droplets when an ink having viscosity of 6 mPa·s is ejected. The heads HD used in these drawings are equal to the head HD used in FIG. 7.

Referring to FIG. 12, the amount of ink in a period X1 after the ejection of the ink droplets is convex at a positive side. This indicates that the supply of the ink to the pressure chamber 424 is excessive and thus the meniscus is located at the ejection side rather than the edge of the opening of each of the nozzles 427. The movement of the meniscus to the convex side is a factor for making the ejection of the ink unstable and thus is not preferable. In contrast, referring to FIG. 13, the amount of ink in a period X2 after the ejection of the ink droplets is located at a positive side, but is substantially close to the position of the normal state. This indicates that the meniscus slightly vibrates at a place close to the position of the normal state. That is, the meniscus is stabilized at the position of the normal state.

Accordingly, if the viscosity of the ink is in a range from 6 mPa·s to 20 mPa·s, it is possible to stabilize the ejection of the ink droplets by setting the opening area Snzl of the nozzles 427 to 1/10 or less of the opening area Ssup of the ink supply path 425.

Opening Area Snzl of Nozzles 427

As described above, in view of the stabilization of the ejection of the ink droplets, the opening area Snzl of the nozzles 427 is set to 1/10 or less of the opening area Ssup of the ink supply path 425. As the opening area Snzl of the nozzles 427 is smaller than the opening surface Ssup of the ink supply path 425, the ink is hard to flow in the nozzles 427. Accordingly, the ink depressurized in the pressure chamber 424 largely flows to the ink supply path 425. In addition, if the opening area Snzl of the nozzles 427 is excessively small, the ink droplets are not ejected from the nozzles 427 although the ink is pressurized in the pressure chamber 424.

In order to prevent an ejection failure of the ink droplets, the opening area Snzl of the nozzles 427 is set to 1/20 or more of the opening area Ssup of the ink supply path 425. Accordingly, it is possible to cause the flowing of the ink in the nozzles 427 when the ink is pressurized in the pressure chambers 424 and to eject the ink droplets with certainty.

In addition, even when the opening area Snzl of the nozzles 427 is 1/20 or more of the opening area Ssup of the ink supply path 425, the diameter ϕ427 of the nozzles 427 cannot be smaller than the minimum value. That is, the diameter ϕ427 of the nozzles 427 cannot be smaller than 10 μm. This is because a necessary amount of ink cannot be structurally ejected.

Opening Area Ssup of Ink Supply Path 425

From the above description, the opening area Ssup of the ink supply path 425 may be set in a range from 10 times to 20 times of the opening area Snzl of the nozzles 427. In addition, in the relationship with the area Scav (thickness) of the pressure chamber 424, the opening area Ssup of the ink supply path 425 is preferably set to be longer than 1/3 of the area Scav of the pressure chamber 424 (corresponding to the surface communicating with the ink supply path 425 as the area of the surface partitioning the pressure chamber 424). The ink supply path 425 has a function for attenuating the pressure vibration of the ink after the ejection of the ink droplets in addition to the function for supplying the ink from the common ink chamber 426 to the pressure chamber 424. If this function is focused on, the opening area Ssup of the ink supply path 425 needs to be smaller than the area Scav of the pressure chamber 424. This is because the channel resistance is increased by reducing the opening area.

The channel resistance is internal loss of a medium, and, in the present embodiment, is force which is applied to the ink flowing in the ink channel and is force reverse to the direction in which the ink flows. The channel resistance may be expressed by Equations (2) and (3). That is, like the pressure chamber 424 or the ink supply path 425, the channel resistance $R_{rectangular}$ in the channel having a rectangular parallelepiped shape may be expressed by Equation (2). In addition, like the nozzles 427, the channel resistance $R_{circular}$ of the channel having a circular cross section may be expressed by Equation (3).

$$\text{Channel resistance } R_{rectangular}=(12\times\text{viscosity } \mu\times\text{length } L)/(\text{width } W\times\text{height } H^3) \quad (2)$$

$$\text{Channel resistance } R_{circular}=(8\times\text{viscosity } \mu\times\text{length } L)/(\pi\times\text{radius } r^4) \quad (3)$$

In such Equations (2) and (3), the viscosity μ denotes the viscosity of the ink, L denotes the length of the channel, W denotes the width of the channel, H denotes the height of the channel, and r denote the radius of the channel having the circular cross section.

In addition, by making the channel resistance of the ink supply path 425 higher than the channel resistance of the pressure chamber 424, it is possible to efficiently attenuate the pressure vibration of the ink in the pressure chamber 424 in the ink supply path 425. As a result, it is possible to promptly stabilize the meniscus after the ejection of the ink droplets. That is, this is suitable for the ejection of the ink droplets at a high frequency.

Inertance

The nozzles 427 and the ink supply path 425 may be considered as a pipe in which the ink (medium) flows. Accordingly, when the pressure is applied from the outside of the pipe, as the diameter of the pipe is increased, the ink is easy to be moved and, as the mass of the ink in the pipe is increased, the ink in the pipe is hard to be moved. From such a characteristic, the ease of the movement of the ink in the pipe is expressed by inertance of an acoustic circuit. When the density of the ink is ρ, the cross-sectional area of the surface perpendicular to the ink flowing direction of the channel is S, and the length of the channel is L, the inertance M may be approximately expressed by Equation (4). As shown in FIG. 2B, the length L or the cross-sectional area S of the channel is expressed by the length or the cross-sectional area of each portion of the modeled ink channel. The length L is the length of the ink flowing direction. The cross-sectional area S is the area of the surface substantially perpendicular to the ink flowing direction.

$$\text{Inertance } M=(\text{density } \rho\times\text{length } L)/\text{cross-sectional area } S \quad (4)$$

From Equation (4), the inertance may be considered as the mass of the ink per unit cross-sectional area. In addition, it is difficult to move the ink according to the ink pressure of the pressure chamber 424 as the inertance is increased, and it is easy to move the ink according to the pressure of the pressure chamber 424 as the inertance is decreased.

When the ink having high viscosity is ejected, the inertance of the nozzles 427 is preferably smaller than the inertance of the ink supply path 425. This is because the movement of the meniscus is efficiently performed on the basis of the pressure vibration applied to the ink contained in the pressure chamber 424.

Other Embodiments

Although the printing system having the printer as the liquid ejecting apparatus is described in the above-described embodiments, the disclosure of the liquid ejecting method, the liquid ejecting system and the method of setting the ejection pulse are included. In addition, these embodiments are intended to facilitate the understanding of the invention and not to limit the invention. The invention may be modified or improved without departing the scope thereof and the invention includes the equivalent thereof. In particular, the following embodiments are included in the invention.

Other Heads HD'

Figure 14:
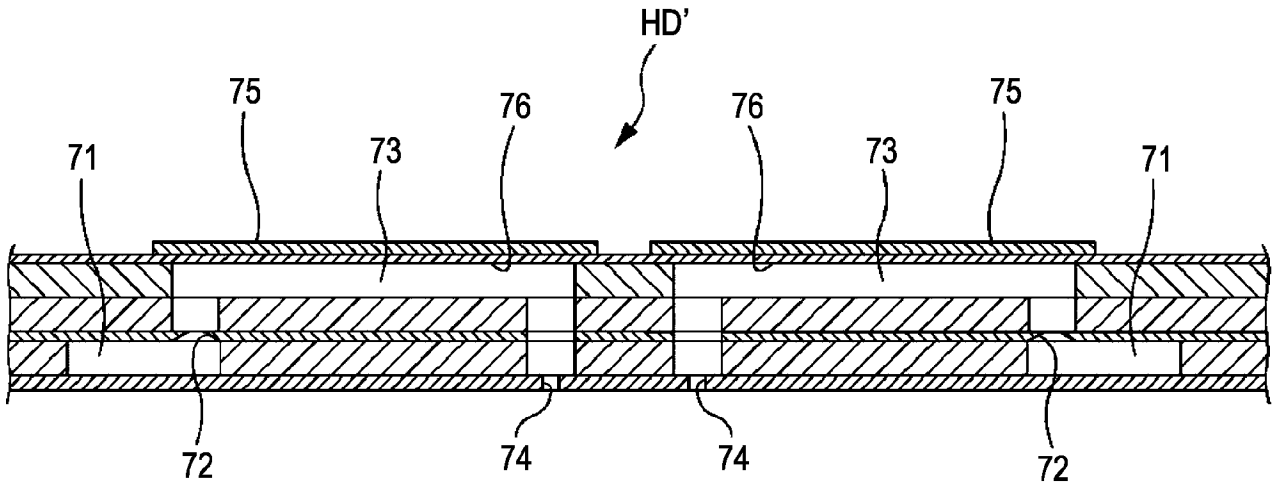
FIG. 14 is a cross-sectional view explaining another head.

In the heads HD of the above-described embodiments, an element which performs an operation for increasing the volume of the pressure chamber 424 as the potential applied by the ejection pulse PS1 is increased was used as the piezo-element 433. Other types of heads may be used. Another head HD' shown in FIG. 14 uses piezo-elements which perform the operation for decreasing the volume of a pressure chamber 73 as the potential applied by the ejection pulse PS2 (see FIG. 15) is increased, as piezo-elements 75.

In brief, another head HD' includes a common ink chamber 71, ink supply openings 72, pressure chambers 73, and nozzles 74. A plurality of ink channels from the common ink chamber 71 to the nozzles 74 via the pressure chambers 73 is included in correspondence with the nozzles 74. Even in another head HD', the volumes of the pressure chambers 73 vary by the operation of the piezo-elements 75. That is, a portion of the pressure chambers 73 is partitioned by a vibration plate 76, and the piezo-elements 75 are provided on the surface of the vibration plate 76 which becomes the opposite side of the pressure chambers 73.

A plurality of piezo-elements 75 is provided in correspondence with the pressure chambers 73. Each of the piezo-elements 75 is configured by sandwiching a piezoelectric body between an upper electrode and a lower electrode (all not shown) and is deformed by applying a potential difference to these electrodes. In this example, if the potential of the upper electrode is increased, the piezoelectric body is charged and thus each piezo-element 75 is bend to be convex to each pressure chamber 73. Accordingly, each pressure chamber 73 contracts. In addition, in another head HD', the portion of the vibration plate 76 which partitions each pressure chamber 73 corresponds to the partitioning portion.

Figure 15:
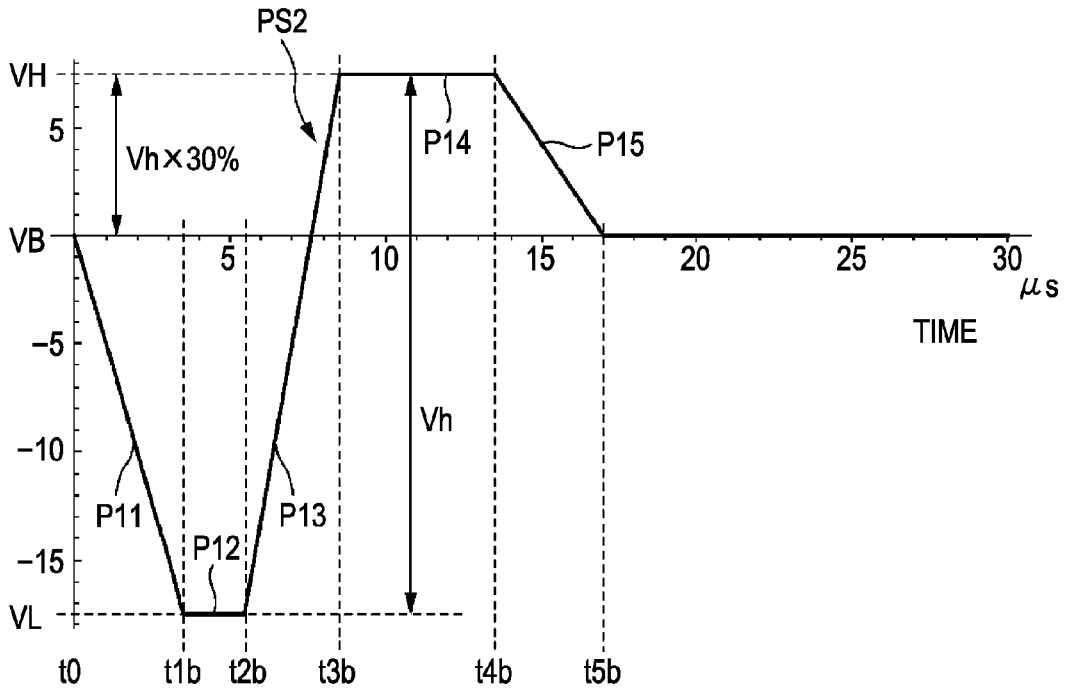
FIG. 15 is a view explaining an ejection pulse for another head.

The ejection pulse PS2 for another head HD' has, for example, the waveform shown in FIG. 15. In brief, this ejection pulse PS2 has the waveform obtained by inverting the above-described ejection pulse PS2 in a potential direction (pitch direction). Accordingly, this ejection pulse PS2 includes a first depressurization portion P11, a first potential holding portion P12, a pressurization portion P13, a second potential holding portion P14 and a second depressurization portion P15.

The first depressurization portion P11 has a start potential which is set to an intermediate potential VB and an end potential which is set to a lowest potential VL and is generated from a timing t0 to a timing t1*b*. The first potential holding portion P12 is held in the lowest potential VL and is generated from the timing t1*b* to a timing t2*b*. The pressurization portion P13 has a start potential which is set to the lowest potential VL and an end potential which is set to a highest potential VH and is generated from the timing t2*b* to a timing t3*b*. The second potential holding portion P14 is held in the highest potential VH and is generated from the timing t3*b* to a timing t4*b*. The second depressurization portion P15 has a start potential which is set to the highest potential VH and an end potential which is set to the intermediate potential VB and is generated from the timing t4*b* to a timing t5*b*.

The functions of the portions P11 to P15 of the ejection pulse PS2 for another head HD' are equal to the functions of the portions P1 to P5 of the above-described ejection pulse PS1. The intermediate potential VB is set to a potential lower than the highest potential VH of the ejection pulse PS2 by 30% of the driving voltage Vh.

Even another head HD' having such a configuration, if the viscosity of the ink is in a range from 6 mPa·s to 20 mPa·s, it is possible to stabilize the ejection of the ink droplets by setting the opening area of the nozzles 74 on the ejection side to 1/10 or less of the opening area of the ink supply openings 72 on the side of the pressure chamber 73.

Ejection Pulse PS

The above-described ejection pulses PS1 and PS2 are only examples. The waveform (potential variation pattern) of the ejection pulse PS is properly set according to the ejection amount of ink or the viscosity of the ink.

Element for Performing Ejection Operation

In this printer 1, as an element for performing an operation (ejection operation) for ejecting the ink, piezo-elements 433 and 75 are used. The element for performing the ejecting operation is not limited to the above-described piezo-elements 433 and 75. For example, a heating element or a magnetostrictive element may be used. If the piezo-elements 433 and 75 are used as this element like the above-described embodiment, the volumes of the pressure chambers 424 and 73 can be controlled with accuracy on the basis of the potential of the ejection pulse PS.

Shape of Nozzle 427, Ink Supply Path 425 or the Like

In the above-described embodiments, the nozzles 427 have a circular opening shape and are configured by holes penetrating through the nozzle plates 422 in the thickness direction. In other words, the nozzles are configured by through-holes partitioning a circular cylindrical space. In addition, the ink supply path 425 has a rectangular opening shape and is configured by a hole communicating the pressure chamber 424 with the common ink chamber 426. In other words, the ink supply path is configured by a communicating hole partitioning a rectangular cylindrical space.

Figure 16A:
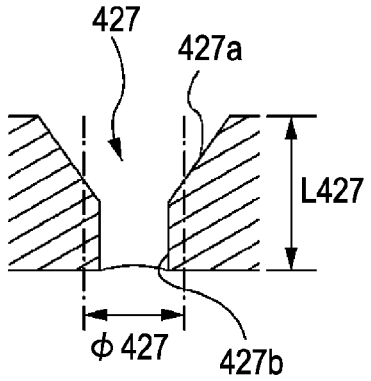
FIG. 16A is a view explaining a funnel-shaped nozzle.

The nozzle 427 or the ink supply path 425 may have various shapes. For example, the nozzle 427 may be configured by substantially funnel-shaped through-holes as shown in FIG. 16A. The shown nozzle 427 has a tapered portion 427*a* and a straight portion 427*b*. The tapered portion 427*a* is a portion partitioning a circular truncated cone-shaped space and the opening area thereof is decreased as separated from the pressure chamber 424. That is, the tapered portion is provided in a tapered shape. The straight portion 427*b* is provided in communication with a small-diameter end of the tapered portion 427*a*. This straight portion 427*b* is a portion partitioning a circular cylindrical space and a portion of which the cross-sectional area is substantially constant in the surface perpendicular to the nozzle direction.

Figure 16B:
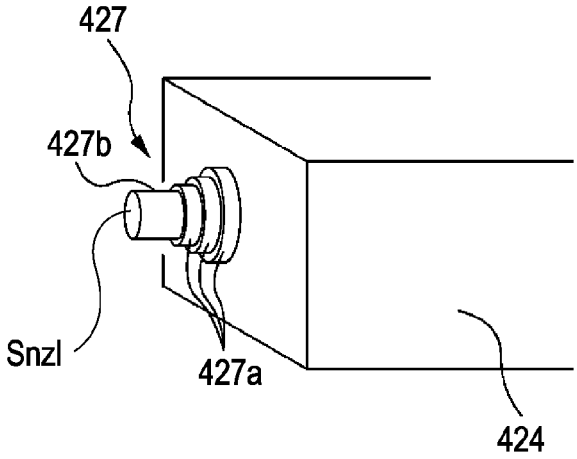
FIG. 16B is a view explaining an analysis model of the funnel-shape nozzle.

This nozzle 427 may be, for example, as shown in FIG. 16B, analyzed by defining the tapered portion 427*a* as a portion partitioning a plurality of disc-like spaces of which the diameters are stepwise decreased. As shown in FIG. 16A, the nozzle may be analyzed by defining the nozzle 427 of which the cross-sectional area of the surface perpendicular to the nozzle direction is constant, which is equivalent to the funnel-shaped nozzle 427.

Figure 16C:
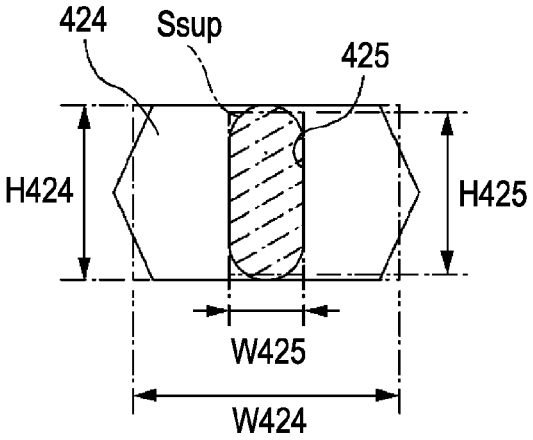
FIG. 16C is a view explaining a modified example of an ink supply path and a pressure chamber.

In addition, the ink supply path 425 may be, for example, as shown in FIG. 16C, configured by a channel having an opening having a vertically elongated ellipse-shape (having a shape obtained by connecting two semicircles having the same radius at a common circumscribed line). In this case, the cross-sectional area Ssup of the ink supply path 425 corresponds to the area of the ellipse-shaped portion denoted by oblique lines. The ink supply path 425 having the ellipse-shaped opening may be analyzed by defining a channel having a rectangular opening equivalent thereto. In this case, the height H425 of the ink supply path 425 is slightly lower than a maximum height of the actual ink supply path 425. In addition, the same is true although the opening of the ink supply path 425 has an ellipse shape.

In addition, the same is true in the pressure chamber 424. As shown in FIG. 16C, if the surface perpendicular to the longitudinal direction of the pressure chamber 424 has a horizontal elongated hexagonal shape, the pressure chamber may be analyzed by defining a channel having a rectangular cross section equivalent thereto. That is, the pressure chamber may be analyzed by defining a channel having the rectangular cross-section of which the height is H424 and the width W424 is slightly smaller than a maximum width of the pressure chamber 424.

Other Application Examples

Although the printer is described as the liquid ejecting apparatus in the above-described embodiments, the invention is not limited to this. For example, the same technique as the present embodiment is applicable to various types of liquid ejecting apparatus using an ink jet technique, such as a color filter manufacturing apparatus, a dyeing apparatus, a micro-fabricated apparatus, a semiconductor manufacturing apparatus, a surface treatment apparatus, a three-dimensional modeling apparatus, a fluid-vaporizing apparatus, an organic EL manufacturing apparatus (more particularly, a polymer EL manufacturing apparatus), a display manufacturing apparatus, a film forming apparatus, a DNA chip manufacturing apparatus, and so on. In addition, methods or manufacturing methods thereof are included in the application range.

What is claimed is:

1. A liquid ejecting method, comprising:

ejecting a liquid from a liquid ejecting head, wherein the viscosity of the liquid is in a range from 6 mPa·s to 20 mPa·s, wherein the liquid ejecting head includes:

a nozzle plate with a nozzle which ejects the liquid;

a pressure chamber which applies a pressure variation to the liquid in order to eject the liquid from the nozzle;

a supply unit which communicates with the pressure chamber and supplies the liquid to the pressure chamber from a liquid storage chamber; and a vibration plate disposed opposite from the nozzle plate, the vibration plate including a laminate of a support substrate and an elastic member, the elastic member forming a portion of the pressure chamber, the supply unit, and the liquid storage chamber, wherein a length of the nozzle is in a range from 40 μm to 100 μm and a diameter of the nozzle is more than 10 μm, an opening area of an opening of the nozzle on the side in which the liquid is ejected is 1/20 or more of an opening area of an opening of the supply unit, and a cross-sectional area of the pressure chamber in a direction transverse to a flow of the liquid from the supply unit is less than three times a cross-sectional area of the supply unit in the direction transverse to the flow of the liquid.

2. The liquid ejecting method according to claim 1, wherein the opening area of the nozzle on the side in which the liquid is ejected is 1/10 or less of the opening area of the opening of the supply unit on the pressure chamber side.

3. The liquid ejecting method according to claim 1, wherein:

the opening of the supply unit has a rectangular shape, the length of one side of the opening is in a range from 30 μm to 500 μm, and the length of the other side of the opening is in a range from 20 μm to 300 μm.

4. The liquid ejecting method according to claim 1, wherein the outer edge of the opening of the supply unit is smaller than that of the surface partitioning the pressure chamber and communicating with the supply unit.

5. The liquid ejecting method according to claim 1, wherein the inertance of the nozzle is smaller than that of the supply unit.

6. The liquid ejecting method according to claim 1, wherein the pressure chamber has a partitioning portion which partitions a portion of the pressure chamber and applies the pressure variation to the liquid by deformation.

7. The liquid ejecting method according to claim 6, wherein the liquid ejecting head includes an element which deforms the partitioning portion by the degree according to a potential variation pattern of an applied ejection pulse.

8. The liquid ejecting method according to claim 1, wherein the diameter of the nozzle is less than 40 μm.

9. A liquid ejecting head comprising:

a nozzle which ejects a liquid;

a pressure chamber which applies a pressure variation to the liquid in order to eject the liquid from the nozzle;

a supply unit which communicates with the pressure chamber and supplies the liquid to the pressure chamber from a liquid storage chamber; and a vibration plate disposed opposite from the nozzle plate, the vibration plate including a laminate of a support substrate and an elastic member, the elastic member forming a portion of the pressure chamber, the supply unit, and the liquid storage chamber, wherein a length of the nozzle is in a range from 40 μm to 100 μm, and a diameter of the nozzle is more than 10 μm, an opening area of an opening of the nozzle on the side in which the liquid is ejected is 1/20 or more of an opening area of an opening of the supply unit, and a cross-sectional area of the pressure chamber in a direction transverse to a flow of the liquid from the supply unit is less than three times a cross-sectional area of the supply unit in the direction transverse to the flow of the liquid.

10. A liquid ejecting apparatus comprising:

an ejection pulse generation unit which generates an ejection pulse; and a liquid ejection head which ejects a liquid from a nozzle formed in a nozzle plate, the liquid ejection head including:

a pressure chamber which deforms a partitioning portion and applies a pressure variation to the liquid in order to eject the liquid from the nozzle;

an element which deforms the partitioning portion by the degree according to a potential variation pattern of an applied ejection pulse;

a supply unit which communicates with the pressure chamber and supplies the liquid to the pressure chamber from a liquid storage chamber; and a vibration plate disposed opposite from the nozzle plate, the vibration plate including a laminate of a support substrate and an elastic member, the elastic member forming a portion of the pressure chamber, the supply unit, and the liquid storage chamber, wherein a length of the nozzle is in a range from 40 μm to 100 μm, and a diameter of the nozzle is more than 10 μm, an opening area of an opening of the nozzle on the side in which the liquid is ejected is 1/20 or more of an opening area of an opening of the supply unit, and a cross-sectional area of the pressure chamber in a direction transverse to a flow of the liquid from the supply unit is less than three times a cross-sectional area of the supply unit in the direction transverse to the flow of the liquid.

* * * * *